US008188938B2

(12) United States Patent
Jang

(10) Patent No.: US 8,188,938 B2
(45) Date of Patent: May 29, 2012

(54) PLASMA DISPLAY DEVICE CONFIGURED TO CHANGE THE DRIVING WAVEFORM ACCORDING TO TEMPERATURE AND A DRIVING METHOD THEREOF

(75) Inventor: Hyukjun Jang, Yongin-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 836 days.

(21) Appl. No.: 12/106,943

(22) Filed: Apr. 21, 2008

(65) Prior Publication Data

US 2008/0266285 A1 Oct. 30, 2008

(30) Foreign Application Priority Data

Apr. 26, 2007 (KR) ..... 10-2007-0040862

(51) Int. Cl.
*G09G 5/00* (2006.01)

(52) U.S. Cl. ..... 345/60

(58) Field of Classification Search ..... 345/60, 345/214

See application file for complete search history.

(56) References Cited

U.S. PATENT DOCUMENTS 5,245,325 A * 9/1993 Terada ..... 345/101
7,839,359 B2 * 11/2010 Choi et al. ..... 345/60
2006/0268180 A1 * 11/2006 Chou ..... 348/673
2006/0273992 A1 * 12/2006 Kim et al. ..... 345/68
2006/0290875 A1 * 12/2006 Shives et al. ..... 349/161
2007/0052626 A1 * 3/2007 Kim et al. ..... 345/68
2007/0252788 A1 * 11/2007 Kim ..... 345/67
2009/0128542 A1 * 5/2009 Takeda et al. ..... 345/214

FOREIGN PATENT DOCUMENTS

JP 11-282408 10/1999
JP 2002207449 A * 7/2002

(Continued)

OTHER PUBLICATIONS

Patent Abstracts of Japan, Publication No. 11-282408; Date of Publication: Oct. 15, 1999; in the name of Kenichi Kawasaki.

(Continued)

*Primary Examiner* — Chanh Nguyen
*Assistant Examiner* — John Kirkpatrick
(74) *Attorney, Agent, or Firm* — Christie, Parker & Hale, LLP

(57) ABSTRACT

A plasma display device including: a display panel for displaying an image according to a driving signal converted from an external image signal; a logic controller for measuring a temperature of the display panel for comparison with a temperature section information having at least two temperature sections, generating a driving control signal for changing the driving signal when the temperature of the display panel changes to a temperature of a different temperature section, and calculating a changing condition included in the driving control signal for determining a changing time of the driving signal; and a driver for supplying the driving signal that is changed according to the temperature section at the changing time determined by the changing condition of the driving control signal.

21 Claims, 12 Drawing Sheets

FOREIGN PATENT DOCUMENTS

| | | | | |
|---|---|---|---|---|
| JP | 2003-280572 | A | | 10/2003 |
| JP | 2003280572 | A | * | 10/2003 |
| JP | 2004-325768 | A | | 11/2004 |
| KR | 10-2005-0106695 | | | 11/2005 |
| KR | 10-2006-0099639 | | | 9/2006 |
| KR | 10-2006-0127540 | | | 12/2006 |
| KR | 10-2007-0015341 | | | 2/2007 |

OTHER PUBLICATIONS

Korean Patent Abstracts, Publication No. 1020050106695 A; Date of Publication: Nov. 11, 2005; in the name of Joeng Pil Choi, et al.

Korean Patent Abstracts, Publication No. 1020070015341 A; Date of Publication: Feb. 2, 2007; in the name of Yun Kwon Jung, et al.

* cited by examiner

PLASMA DISPLAY DEVICE CONFIGURED TO CHANGE THE DRIVING WAVEFORM ACCORDING TO TEMPERATURE AND A DRIVING METHOD THEREOF

CLAIM FOR PRIORITY

This application claims priority to and the benefit of Korean Patent Application No. 10-2007-0040862 filed on Apr. 26, 2007 in the Korean Intellectual Property Office (KIPO), the entire content of which is incorporated herein by reference.

BACKGROUND OF THE INVENTION

1. Field of the Invention

The present invention relates to a plasma display device and a driving method thereof.

2. Description of the Related Art

The plasma display panel (or device) displays an image by emitting electrons with a high voltage, exciting inert gas sealed between substrates of the display panel by the emitted electrons to emit ultra violet rays, and exciting phosphors to emit visible ray. Due to such characteristics, the plasma display panel is relatively sensitive to the temperature of the display panel and the environment when being driven, compared with other flat display devices. Recently, the plasma display panel displays high quality images regardless of temperature by dividing the temperature of the display panel or the environment into several sections and changing the driving waveform or the operation environment depending on the temperature. Driving the plasma display panel by dividing the temperature sections prevents an over-discharge generated at a relatively low temperature and a low-discharge generated at a relatively high temperature when a same driving waveform is applied.

However, dividing the temperature of the display panel into several temperature or environment sections causes another problem. A typical problem is that flicker, i.e., twinkle, occurs when the driving waveform is changed depending on the temperature section. The flicker phenomenon causes the user to feel that a moving image in the plasma display device is disconnected. In other words, the user can recognize that the image quality of the plasma display device is lowered as compared with other display devices.

SUMMARY OF THE INVENTION

An aspect of an embodiment of the present invention is to provide a plasma display device and a driving method thereof that can change and select a changing time of a driving waveform so as to minimize production of flicker when the plasma display device is driven by a different driving waveform according to the temperature.

Another aspect of an embodiment of the present invention is to provide a plasma display device and a driving method thereof that can minimize production of flicker and the recognition of flicker by users, using various methods of determining a supply time of a driving waveform to minimize the flicker when the driving waveform is changed.

Another aspect of an embodiment of the present invention is to provide a plasma display device and a driving method thereof that can provide a range of the supply time of the driving waveform that prevents the production of misfiring while minimizing the production of flicker so as to provide a good quality image.

An embodiment of the present invention provides a plasma display device including: a display panel for displaying an image according to a driving signal converted from an external image signal; a logic controller for measuring a temperature of the display panel for comparison with a temperature section information having at least two temperature sections, generating a driving control signal for changing the driving signal when the temperature of the display panel changes to a temperature of a different temperature section, and calculating a changing condition included in the driving control signal for determining a changing time of the driving signal; and a driver for supplying the driving signal that is changed according to the temperature section at the changing time determined by the changing condition of the driving control signal.

The logic controller may include a timer for measuring an entering time period when the temperature of the display panel changes to a temperature of a different temperature section.

The driver may be configured to change and supply the driving signal prior to the changing condition when the entering time period exceeds a limit time.

The hanging time may be a time when an average signal level of the image signal is below a reference average signal level.

The changing time may be a time when a displayed gray level of the image signal is below a reference gray level.

The changing time may be a time when an optical axis calculated by an optical histogram analysis for the image signal is within a reference range of the optical axis.

The changing time may be a time when the amount of light emitted according to the image signal is below a reference amount of light.

The image signal may be an image signal that corresponds to 50% of the display panel comprising a central part of the display panel.

The temperature sections may include a low temperature section, a normal temperature section, and a high temperature section.

The low temperature section may be less than about 18° C., the normal temperature section may be more than about 18° C. and less than about 50° C., and the high temperature section may be more than about 50° C.

The driving signal may include a signal where a main reset is supplied more than at least twice in the low temperature section.

The driving signal, at least one of a charging time and a discharging time of an energy recovery circuit in the high temperature section may be shorter in duration than other at temperature sections.

Another embodiment of the present invention provides a method of driving a plasma display device utilizing a driving signal, converted from an external image signal according to a temperature section based on a temperature of a display panel, the method including: measuring the temperature of the display panel; comparing the measured temperature with temperature section information having at least two temperature sections; generating a driving control signal for changing the driving signal when the measured temperature changes to a temperature within a different temperature section; calculating a changing condition included in the driving control signal for determining a changing time of the driving signal; selecting the changing time by the changing condition according to the driving control signal; and supplying the driving signal for each of the temperature sections according to the selected changing time.

The method may further include measuring an entering time period when the temperature of the display panel is changed to a temperature within a different temperature section.

The method may further include determining whether the entering time period exceeds a limit time.

The said determining may include supplying the driving signal that corresponds to the temperature section prior to the changing condition when the entering time period exceeds the limit time.

The said selecting may include determining whether an average signal level of the image signal is below a reference average signal level.

The said selecting may include determining whether an screen gray level of the image is below a reference screen gray level.

The said selecting may include determining whether an optical axis calculated by an optical histogram analysis of the image signal is within a reference range of the optical axis.

The said selecting may include determining whether the amount of light emitted according to the image signal is below a reference amount of light.

The image signal may correspond to 50% of the area of the display panel comprising a central part of the display panel.

The temperature sections may include a low temperature section, a normal temperature section and a high temperature section.

The low temperature section may be less than about 18° C., the normal temperature section may be more than about 18° C. and less than about 50° C., and the high temperature section may be more than about 50° C.

The said supplying may include supplying a main reset at least twice in the low temperature section.

The said supplying may include changing at least one of a charging time and a discharging time of an energy recovery circuit in the high temperature section, so as to have a shorter duration than other temperature sections.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
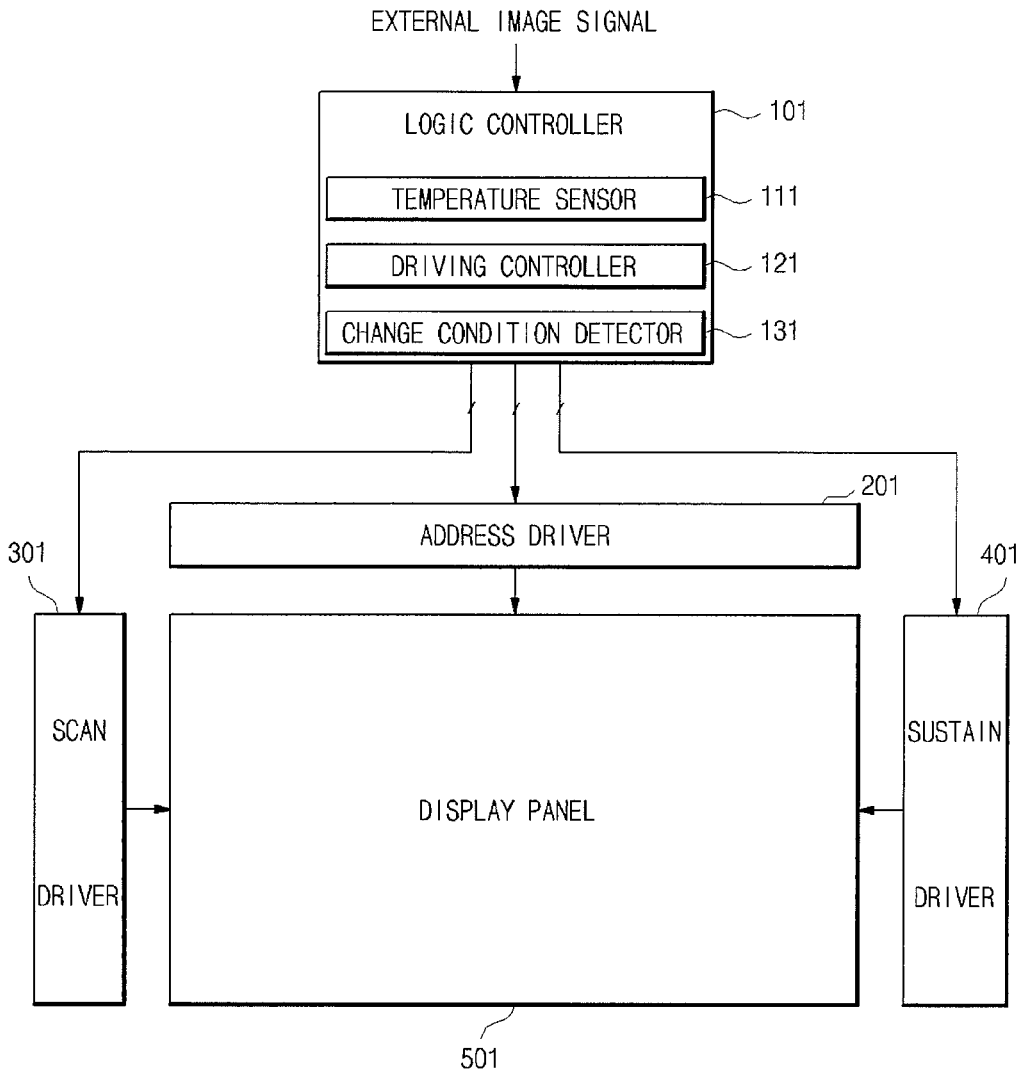
FIG. 1 is a diagram illustrating a plasma display device according to an embodiment of the present invention.

In the following detailed description, only certain exemplary embodiments of the present invention have been shown and described, simply by way of illustration. As those skilled in the art would realize, the described embodiments may be modified in various different ways, all without departing from the spirit and scope of the present invention. Accordingly, the drawings and description are to be regarded as illustrative in nature and not restrictive. Like reference numerals designate like elements throughout the specification.

In addition, embodiments of the present invention are described for a single scan type, ADS (Address Display Separate), three electrode surface discharge type structure as an example, but the present invention is not limited thereto.

FIG. 1 is a diagram illustrating a plasma display device according to an embodiment of the present invention;

Referring to FIG. 1, the plasma display device includes a logic controller 101, drivers 201, 301 and 401 and a display panel 501.

The logic controller 101 converts a received image signal to a data signal that can be processed in the plasma display device and supplies the converted data signal to the drivers 201, 301 and 401. Specially, the logic controller 101 detects the temperature of the display panel 501 in operation and controls the drivers 201, 301 and 401 so as to supply different waveforms according to temperature. For this purpose, the logic controller 101 includes a temperature sensor 111 for detecting the temperature of the display panel 501, a driving controller 121 for producing a driving control signal (DCS), and a changing condition detector 131 for detecting a changing condition of a driving waveform. Furthermore, the logic controller 101 may further include a subfield generating part that divides a data signal (DS) into several subfields.

The temperature sensor 111 produces temperature data (TED) by detecting the temperature of the display panel 501 and supplying the temperature data to the driving controller 121. The temperature sensor 111 may be controlled to detect the temperature of the display panel 501 only when a control signal of the driving controller 121 is generated, but may detect the temperature in a constant cycle for improved operation.

The driving controller 121 receives the temperature data (TED) from the temperature sensor 111, identifies the temperature section where the display panel 501 is driven, and determines whether to change the driving waveform. For this, temperature section information (TSD) (e.g., a predetermined TSD) is stored in the driving controller 121. Here, the temperature section information (TSD) is defined by at least two different temperature sections, where the plasma display device in each temperature section should be driven by a different driving waveform. The temperature section information (TSD: Temperature Section Data) may be divided into a low temperature section, a normal temperature section, and a high temperature section, and it may be divided into more sections depending on the inherent characteristics of the plasma display device. Then, based upon the plasma display device, the low temperature may be less than about 18° C., the normal temperature may be about 18° C. to about 50° C., and the high temperature may be more than about 50° C. The driving controller 121 determines the changing of the driving waveform when the temperature of the display panel 501 is within the temperature section where a changing of the driving waveform is required, and identifies a waveform changing condition (PCC: Pulse Change Condition) for identifying the changing time of the driving waveform to prevent flicker. The waveform changing condition (PCC) is described in detail hereinafter. The driving controller 121 supplies the driving control signal (DCS) to the drivers 201, 301 and 401 so that the driving waveform is changed when the waveform changing time is determined depending on the identification of the waveform changing condition (PCC). Herein, a driving time may be included in the waveform changing condition (PCC). In this case, a timer may be further included in any one of the logic controller 101 or the driving controller 121.

The change condition detector 131 detects the waveform changing condition (PCC) for determining the changing time of the driving waveform so that the driving waveform is changed at a time which can reduce or minimize the generation of flicker. For this, the change condition detector 131 may use any one of an average signal level measuring part, a histogram analyzing part, a gray level analyzing part, and a timer, or a combination thereof.

The drivers 201, 301 and 401 supply the data signal (DS) received from the logic controller 101 to the display panel 501 to display the image. Specifically, the drivers 201, 301 and 401 supply a different driving waveform for each temperature section (TS) to the display panel 501 according to the driving control signal provided from the logic controller 101. For this, the drivers 201, 301 and 401 are divided into an address driver 201, a scan driver 301, and a sustain driver 401.

The address driver 201 supplies an address signal (ADD) to the display panel 501 in an address period (ADP). An energy recovery circuit (ERC) may be included in the address driver 201. The address driver 201 is connected to address electrodes of the display panel 501.

The sustain driver 401 supplies a sustain signal (SUP_X) to the display panel 501 in a sustain period (SUP: Sustain Period). The energy recovery circuit (ERC) may be also included in the sustain driver 401. The sustain driver 401 is connected to sustain electrodes of the display panel 501.

The scan driver 301 supplies a reset signal (RES: Reset Pulse) in a reset period (REP: Reset Period), a scan signal (SCA: Scan Pulse) in an address period (ADP), and a sustain signal (SUS_Y) in the sustain period (SUP) to the display panel 501. The energy recovery circuit (ERC) may be also included in the scan driver 301, and the scan driver 301 is connected to scan electrodes of the display panel 501.

Figure 2A:
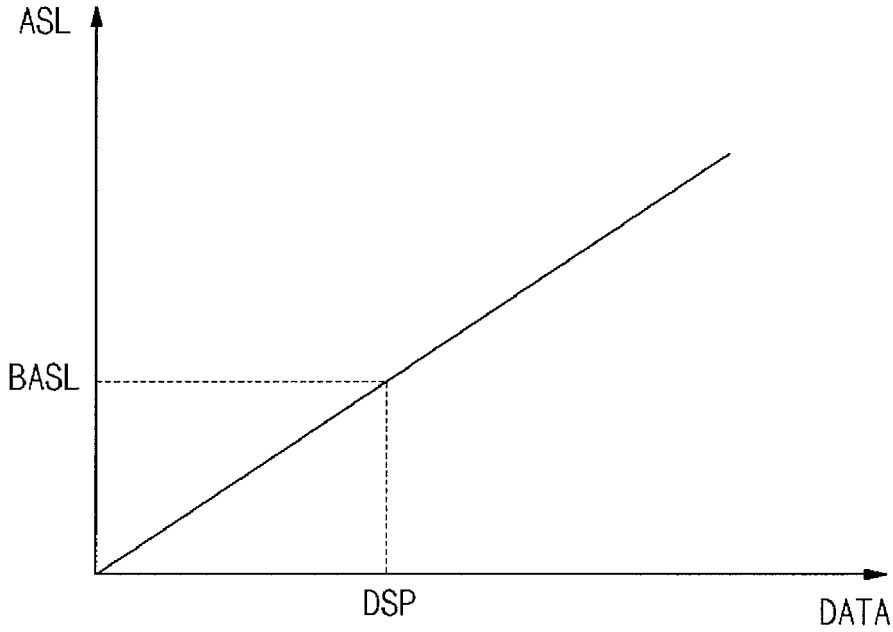
FIG. 2*a* is a diagram illustrating an example of calculating a waveform changing condition using an average signal level.
Figure 2B:
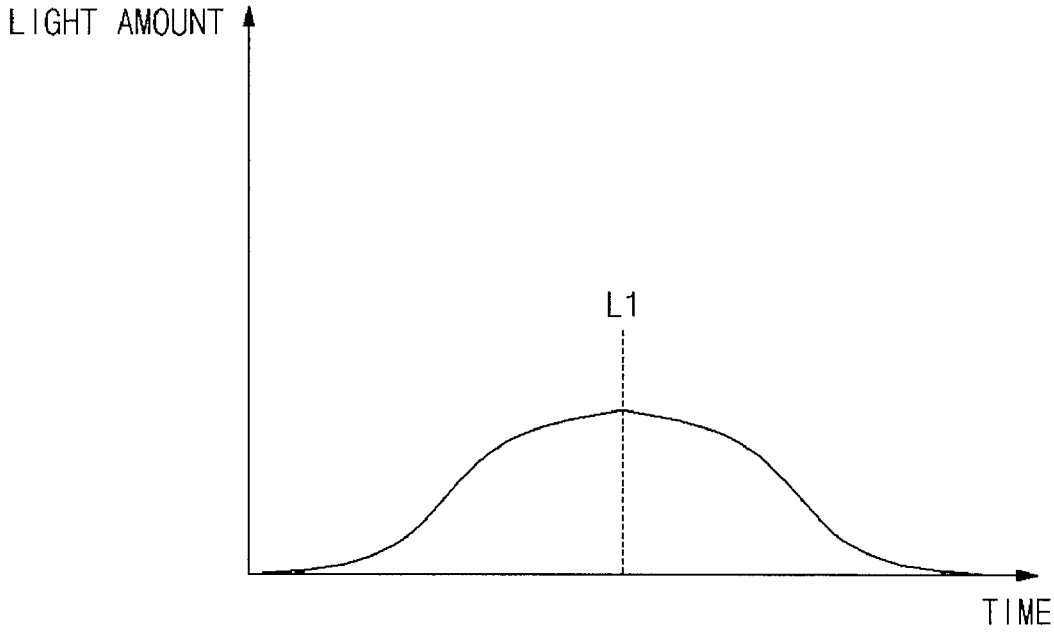
FIG. 2*b* is a diagram illustrating an example of calculating a waveform changing condition using an optical histogram.
Figure 2C:
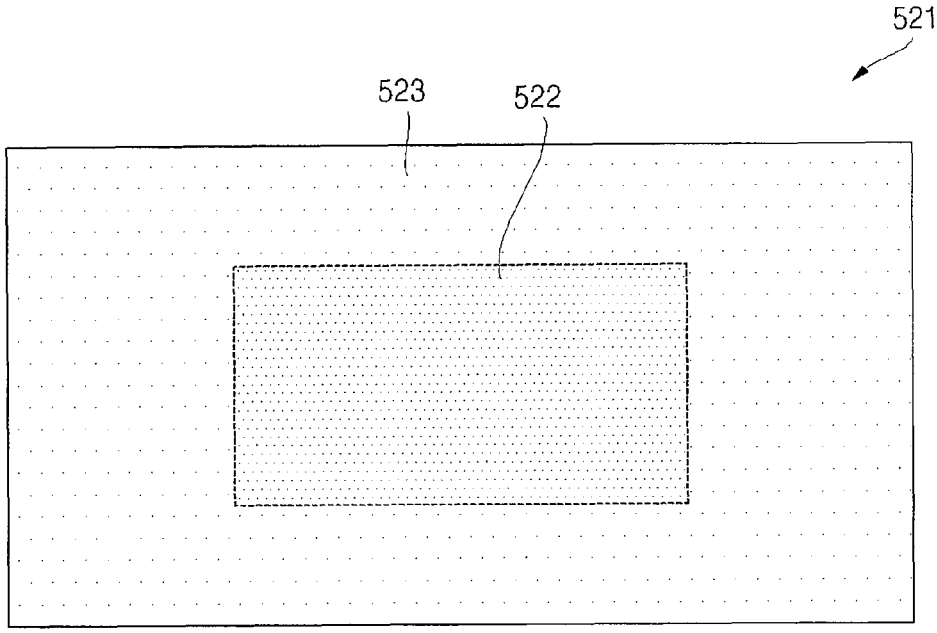
FIG. 2*c* is a diagram illustrating an example of calculating an average signal level or a gray level of the middle of the screen.

FIGS. 2*a*, 2*b*, and 2*c* are diagrams illustrating examples of calculating a waveform changing condition, where FIG. 2*a* shows an average signal level, FIG. 2*b* shows an optical histogram, and FIG. 2*c* shows an example of calculating a gray level of the middle of the screen or the average signal level.

Referring to FIGS. 2*a*, 2*b*, and 2*c*, the waveform changing condition (PCC) can be calculated by various methods. Here, flicker is most frequently generated by movement of the optical axis when the driving waveform is changed. As a result, the described embodiment of the present invention reduces flicker by a method that prevents the movement of the optical axis depending on the change of the driving waveform, or changes the driving waveform when it is difficult for the user to recognize movement of the optical axis. Accordingly, methods that use an average signal level (ASL) measurement, a histogram calculation, or a gray level analysis as the waveform changing condition are shown.

FIG. 2*a* shows an increasing average signal level (ASL). The value of the average signal level (ASL) is not always increased linearly. The method of measuring the average signal level (ASL) is a method for changing the driving waveform when it is difficult for the user to recognize. In other words, the method of measuring the average signal level changes the driving waveform by outputting a data signal (DS) below a reference average signal level (BASL: Base ASL) and concurrently generating a driving control signal. When a data signal (DS) having a low average signal level is outputted, the display panel 501 outputs generally dark images. At this time, even if flicker is generated by movement of the optical axis, it is difficult for the user to recognize the generation of flicker because of the small amount of light outputted by the dark image. Therefore, if the driving waveform is changed when the average signal level (ASL) for the data signal (DS) is below the reference average signal level (BASL), after selecting the average signal level (ASL) for the specific data signal (DSP) as the reference average signal level (BASL), as shown in FIG. 2*a*, then the user cannot recognize the generation of flicker.

FIG. 2*b* is a diagram illustrating the generation of flicker by movement of the optical axis. FIG. 2*b* shows the amount of the light in the sustain period, but may be different to FIG. 2*b* if one subfield or one frame period is illustrated. As shown in FIG. 2*b*, the amount of light displayed by the sustain discharge is low at the beginning and end of the sustain period and high at the middle of the sustain period. Here, the optical axis (L1) is formed at the point where the amount of the light is highest, and if the optical axis is moved, the user can recognize the generation of flicker. For example, in the case where a main reset waveform is added to the driving waveform, a period difference that corresponds to the main reset is generated between the driving waveform that is not added by the main reset and the driving waveform that is added by the main reset. This causes the user to recognize flicker when the driving waveform is changed. However, the generation of flicker can be reduced or prevented by reducing or minimizing the movement of the optical axis or making flicker unrecognizable by the user by analyzing the optical histogram. For example, the user cannot recognize the generation of flicker if the optical axis is gradually moved per unit frame or unit subfield by analyzing the histogram when the optical axis is delayed (i.e., when it is moved to the right along the time axis). If the optical axis is in substantially the same position even though the driving waveform is changed by a discharge control, the user does not recognize the generation of flicker. This can be accomplished by controlling the operation timing of the energy recovery circuit or controlling the period of the main reset.

On the other hand, by using the method of analyzing the optical histogram, if the driving waveform is changed after a high gray level, (i.e., a gray level or an image that has a relatively large amount of light), flicker can be easily recognized by the user even if the movement range of the optical axis is small. In other words, when the amount of light is large, the movement range of the optical axis, (i.e., the range that the user does not recognize the movement of the optical axis) becomes very narrow. However, when the image displayed has a low amount of light, the movement range of the optical axis is relatively wide. Accordingly, when the optical histogram analysis is used, it is possible to use a method of control so that the optical axis according to the changed driving signal is located in the range of the optical axis of a former image. Therefore, it is difficult for the user to recognize flicker by selecting a range about the optical axis of former data or the driving signal, and by changing the driving signal when the optical axis according to a newly inputted data is included in the selected range. This method may be executed during a low gray level, i.e., a dark image is displayed, because the user can easily recognize and conveniently control the image.

In addition, when the gray level of the full screen is below a reference gray level (e.g., a predetermined grey level), the driving waveform can be changed. In other words, when a dark image is displayed, the driving waveform can be changed. For example, when the image being displayed if that of night, the plasma display device performs a display discharge only at a subfield having a low value among a plurality of subfields. Here, because the amount of the generated light is small when the driving waveform is changed, it is difficult for the user to recognize flicker even if it is generated.

FIG. 2*c* shows a method of identifying an average signal level or a gray level about only the middle part of the display panel. This method considers that users generally look at the middle of the screen. In cases of average signal level, when the signal level of the full screen is measured, there is no problem except that the amount of the data to be processed is increased. However, because the gray level of the full screen rarely falls down below a certain level, it may be more effective to be limited to a particular region. Accordingly, when the image displayed on a middle part 522 of the screen has a signal level below the average signal level (ASL), or when an image having a gray level below the reference gray level is displayed on the middle part, the driving waveform is changed so as to decrease the amount of the data to be processed and simultaneously decrease the generation of flicker. The gray level or the average signal level is measured on the middle part 522 of the display panel 521 shown in FIG. 2*c*. In addition, even though the gray level or the average signal level of a peripheral part 523 is excluded from the measurement, it is preferable to change the driving waveform when the signal level is low or the gray scale level is low.

Figure 3:
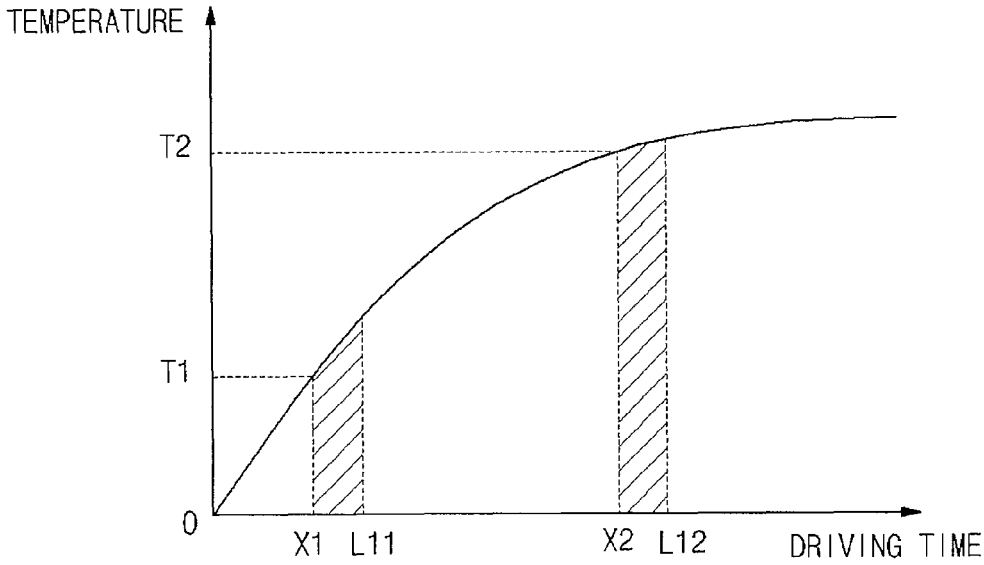
FIG. 3 is a diagram illustrating a changing time where a timer is a changing condition detector.

FIG. 3 is a diagram illustrating the changing time when a timer is included as a change condition detector.

Referring to FIG. 3, a misfiring is generated when a certain time elapses in a state where a waveform changing condition (PCC) described in FIG. 2 is not satisfied. Accordingly, by setting a limit time for determining whether or not the waveform changing condition (PCC) is satisfied, the plasma display device can be smoothly driven. In FIG. 3, a horizontal axis indicates a lapse of a driving time and a vertical axis indicates a temperature change of the display panel. A first temperature section is from a starting point (0) to a first temperature (T1), a second temperature section is from the first temperature (T1) to a second temperature (T2), and a third temperature section is a section that maintains the temperature over the second temperature (T2). The plasma display device in each temperature section is driven by a different driving waveform, and the first temperature (T1) and the second temperature (T2) become a changing time of the driving waveform. However, considering the waveform changing condition (PCC) of FIG. 2, the driving waveform is not immediately changed at a first time (X1) and a second time (X2). However, when a reference time lapses (e.g., predetermined time), misfiring is generated, thereby deteriorating the display quality. As a result, image quality degrades if the waveform changing condition (PCC) is not satisfied within a reference time period (e.g., a predetermined time period). Accordingly, when limit times L11 and L12 are exceeded, it is preferable to change the driving waveform regardless of the generation of flicker. In other words, the driving waveform is changed regardless of satisfaction of the waveform changing condition (PCC) when a certain time elapses after entering into a different temperature section (TS). In the case of a commercial plasma display device, misfiring is generated when about five minutes elapse after the temperature of the display panel is changed to a new temperature section. Of course, this time is different according to the characteristic of the plasma display device. Therefore, it is preferable to control the limit time (L11, L12) to within five minutes. A shaded part in FIG. 3 is a time when the driving waveform can be changed, depending on the satisfaction of the waveform changing condition (PCC).

Figure 4A:
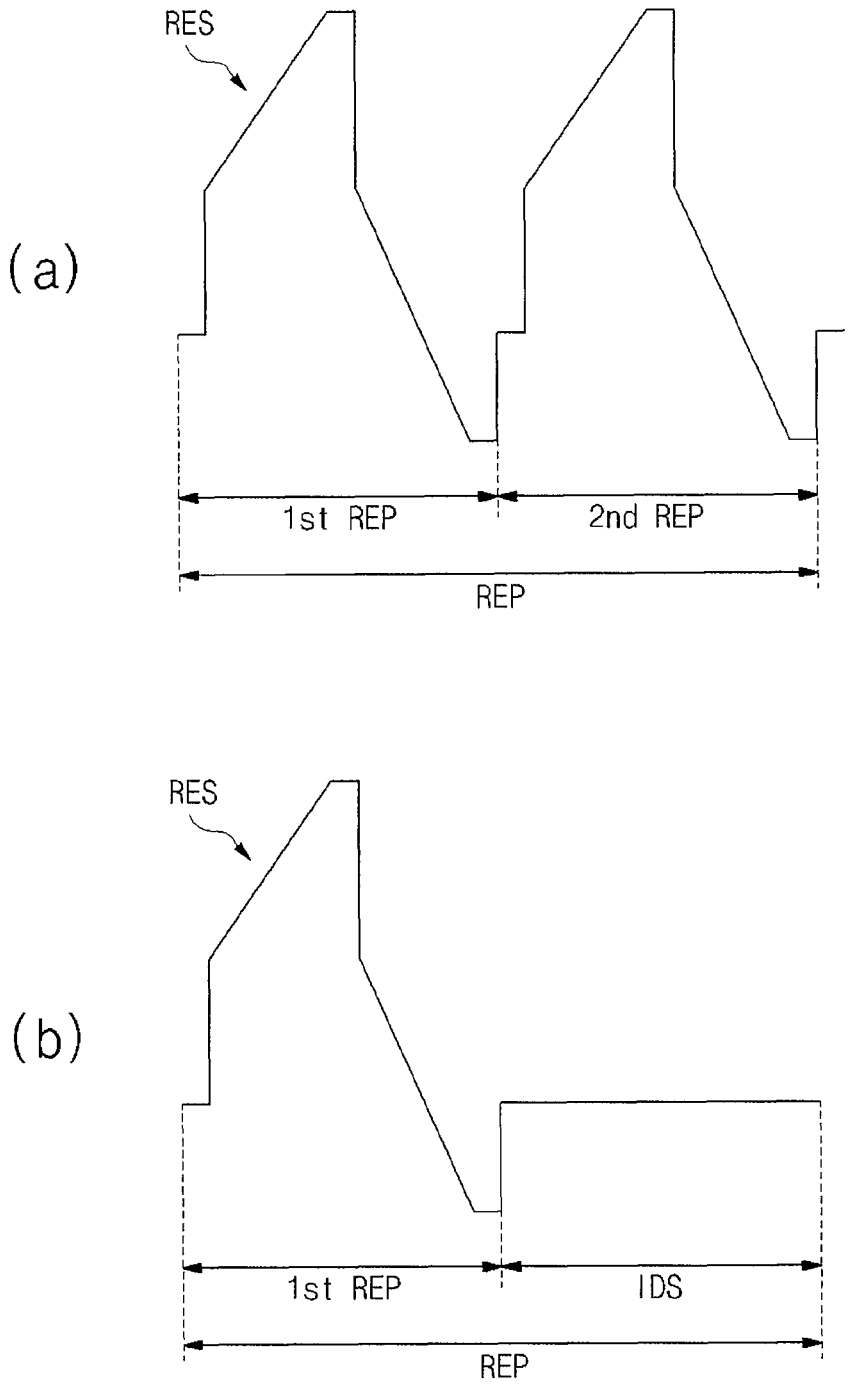
FIG. 4*a* is a diagram illustrating a driving waveform in which a main reset has been changed.
Figure 4B:
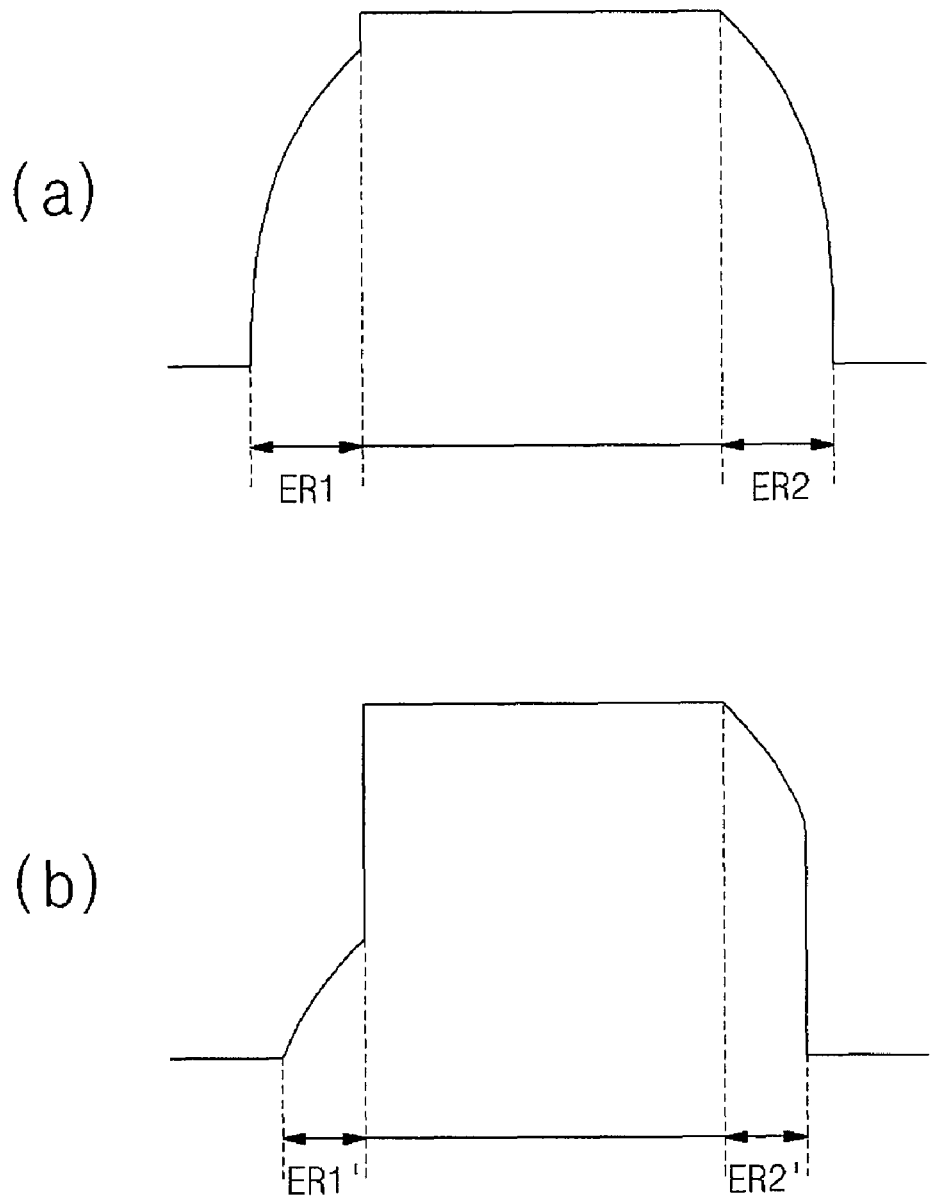
FIG. 4*b* is a diagram illustrating an example in which an operation timing of the energy recovery circuit has been changed.

FIGS. 4*a* and 4*b* are diagrams illustrating driving waveforms supplied according to the temperature section. FIG. 4*a* shows an example where a main reset is changed, and FIG. 4*b* shows an example where an operation timing of an energy recovery circuit is changed.

Referring to FIG. 4*a*, (a) shows a waveform supplied in a low temperature section, and (b) shows a waveform supplied in the normal temperature section. Generally, because an over-discharge is largely generated in the low temperature, it is possible to reduce or prevent misfiring from being generated by sufficiently stabilizing the discharge cell state in the low temperature. For example, by using the method of repeating the main reset (RES) at least twice, misfiring can be reduced or prevented. Further, because the misfiring at the normal temperature is less than that at the low temperature section or the high temperature section, it is possible to maintain the quality of the display in the normal range even when the main reset (RES) is supplied only once. Herein, the main reset (RES) is an example of the reset signal (RES), so that the reference of the main reset has been given to (RES) same as the reference of the reset signal, that is (RES). Such a main reset (RES) is a waveform having a rising section and a falling section. As shown in FIG. 4*a*, a reset period (REP) in the low temperature section is divided into a first reset period (1st REP) and a second reset period (2nd REP). By increasing the temperature of the display panel, the plasma display device driven by the main reset (RES) is supplied with the driving waveform with one of the main resets (RES) removed. In this case, a period with the removed reset signal (RES) has an idle section (IDS: Idle Section). However, the idle section (IDS) may be not provided. As described above, when the main reset (RES) is decreased by half without the idle time, the optical axis is moved to induce the generation of flicker. However, if the length of the idle section (IDS) is gradually decreased, it is difficult for the user to recognize the movement of the optical axis. If the driving waveform is changed at a time that the user cannot easily recognize, according to the waveform changing condition (PCC) in FIG. 2, it is preferable that the idle time (IDS) is not set.

FIG. 4*b* shows the case where the operation timing of the energy recovery circuit is changed. In FIG. 4*b*, (a) shows a driving waveform that is generally applied in the normal temperature section, and (b) shows a driving waveform that is used frequently in the high temperature section and shortens operation timing of the energy recovery circuit.

Referring to FIG. 4*b*, the operation timing of the energy recovery circuit (ERC) is set so that the energy recovery efficiency is improved or maximized, as shown in (a). In order to accomplish this, a discharge time (ER1) and a charge time (ER2) by a capacitive element included in the energy recovery circuit are sufficiently provided. The discharge of the capacitance element enables an electric potential of the scan electrode to rise to the level that corresponds to a sustain voltage (Vs) without the input of an external power source.

During this time, an external power source is applied so as to supply the sustain voltage (Vs) to the scan electrode. Similarly, after the capacitance element has sufficiently recovered the energy in a charge time (ER2), a ground power is applied to the scan electrode. However, if the same operation time as shown in (a) is provided in the high temperature section, the sustain discharge timing is dispersed. Therefore, even though the energy recovery efficiency is somewhat decreased, it is important to maintain the display quality by matching the discharge timing. As a result thereof, the driving waveform is changed so that the discharge timing is matched by shortening a discharge time (ER1') and a charge time (ER2').

Figure 5:
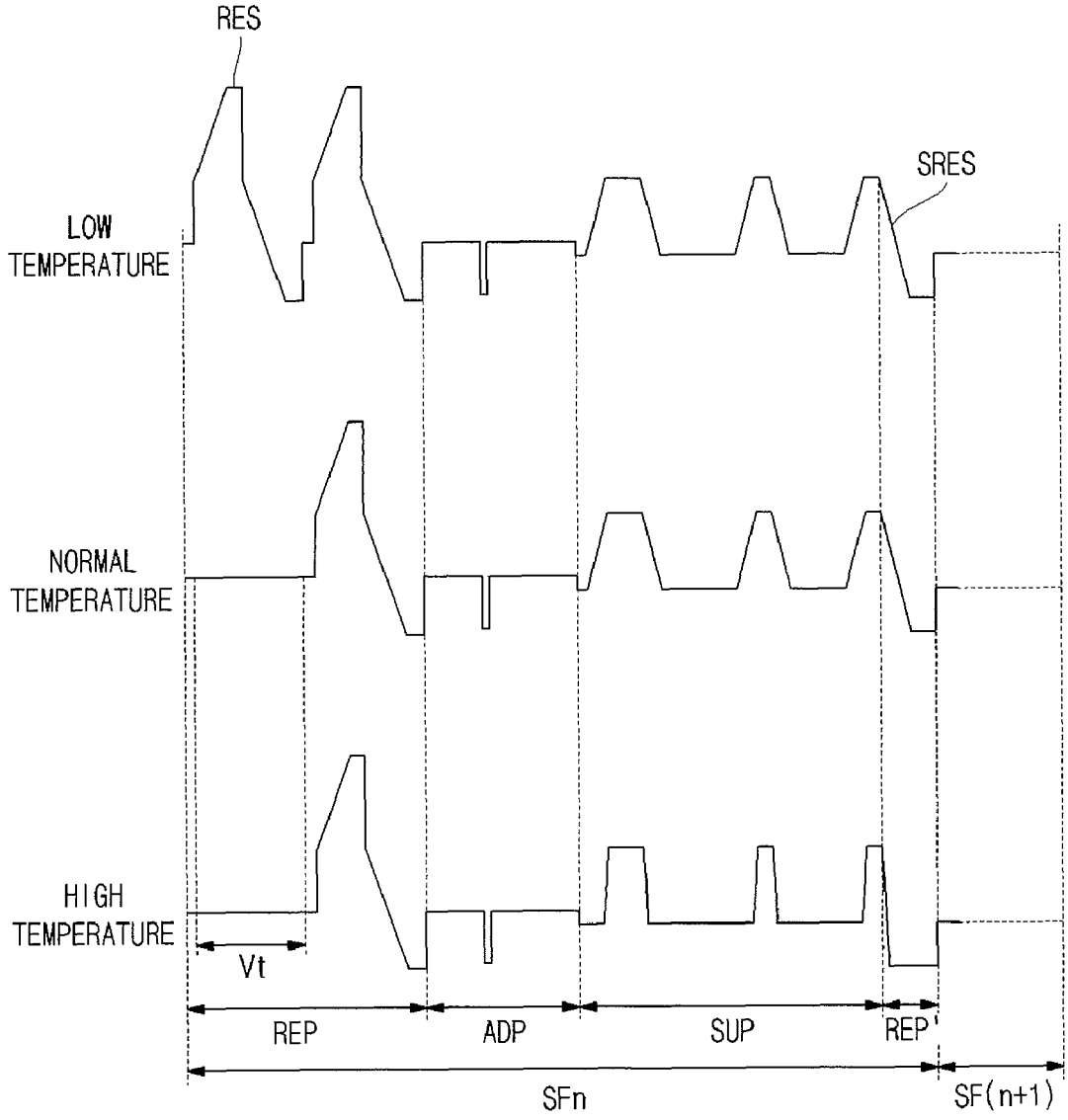
FIG. 5 is a diagram illustrating an example of the driving waveform that is applied to a scan electrode in a low temperature section, a normal temperature section, and a high temperature section.

FIG. 5 illustrates an example of the driving waveform applied to the scan electrodes in a low temperature section, a normal temperature section, and a high temperature section.

Referring to FIG. 5, the quality of display can be maintained at a certain level by supplying different driving waveforms in different temperature sections, as described in reference to FIG. 4. The waveform of FIG. 5 illustrates a driving waveform that can be supplied to the plasma display device, e.g., a driving waveform applied to the scan electrodes.

As shown in FIG. 5, the driving waveform where the main reset (RES) is repeated at least twice is provided at the low temperature. The main reset (RES) can be applied at least twice in the reset period of one or two subfields that constitute one frame. An auxiliary reset (SRES), that is a waveform having a falling section, can replace the main reset (RES) of the subfield that is not supplied with the main reset (RES). When the temperature of the display panel that has been driven in the low temperature section rises to enter into the normal temperature section, the plasma display device is driven by the driving waveform where the main reset (RES) is supplied only once. When the temperature of the display panel enters into the high temperature section, the driving waveform, during the operation period of the energy recovery circuit, is shortened to reduce or prevent misfiring. Here, when each temperature section is changed, the waveform changing condition (PCC) and the limit time (LI) are provided so as to reduce or minimize the generation of flicker caused by the waveform change and recognition by the user. On the other hand, when a main reset (RES) subsequent to the low temperature driving waveform is used, a time gap is generated if the main resets (RES) in the normal temperature or high temperature section is omitted. This may cause the optical axis to be moved, thereby generating flicker. Accordingly, it is possible to use a method of reducing or minimizing the recognition of the flicker by decreasing gradually the interval (Vt) of the main reset (RES) omitted after the driving waveform is changed from the low temperature to the normal temperature.

Figure 6:
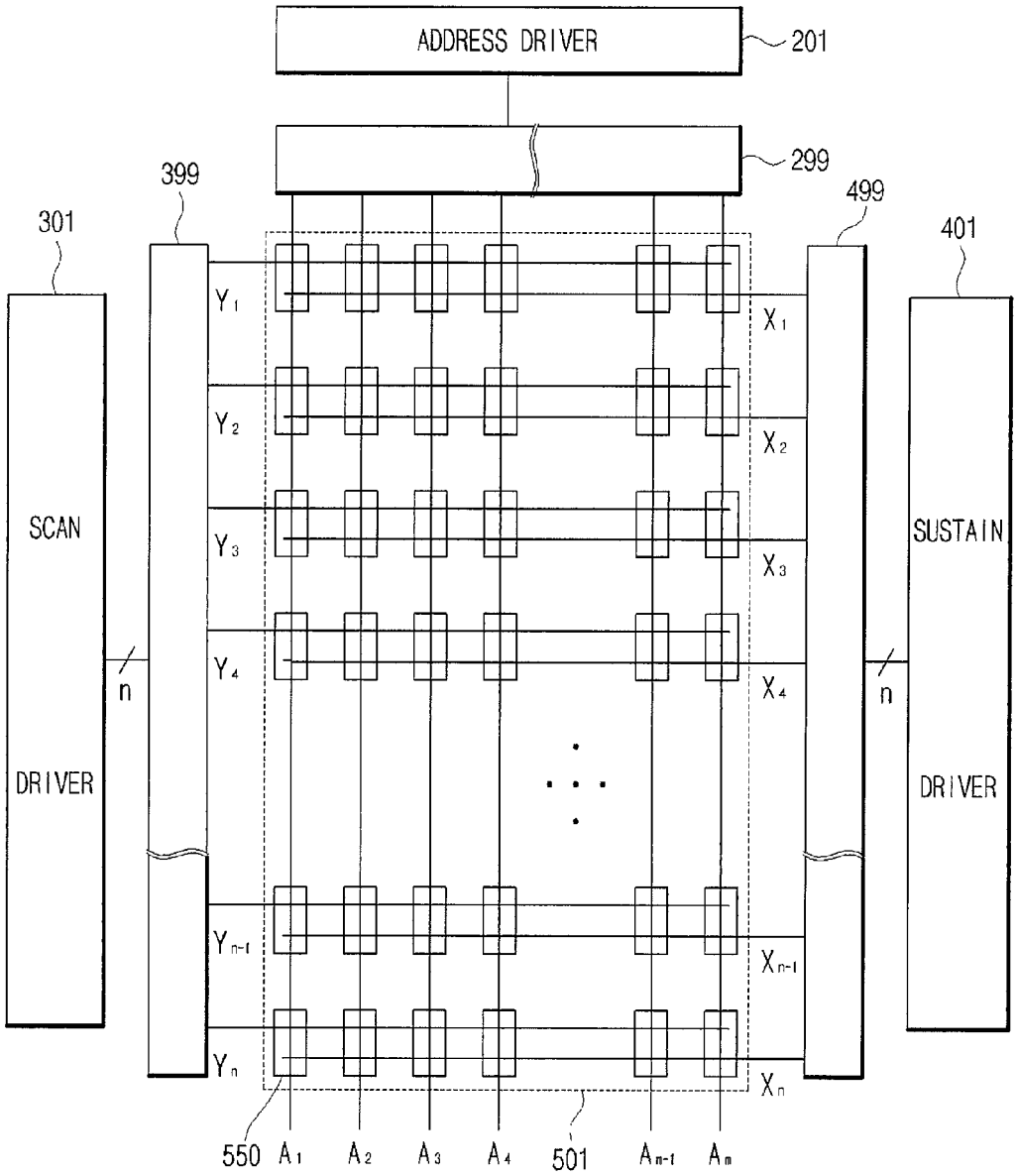
FIG. 6 is a schematic diagram illustrating the relationship between an electrode layout of the display panel and a driver according to an embodiment of the present invention.

FIG. 6 is a schematic diagram illustrating the relationship between an electrode layout of the display panel and a driver applicable to an embodiment of the present invention.

Referring to FIG. 6, the display panel 501 is provided with discharge cells at locations where a plurality of scan electrodes Y1 to Yn, a plurality of sustain electrodes X1 to Xn, and a plurality of address electrodes A1 to Am cross.

The scan electrodes Y1 to Yn supply a reset signal (RES), a scan signal (SCA), and a sustain signal (SUS_Y) from a scan driver 301 to a discharge cell 550, so that the discharge cell 550 is selected and, concurrently, the display discharge is performed.

The sustain electrodes X1 to Xn supply a sustain signal (SUS_X) from a sustain driver 401 to a discharge cell 550 so that display discharge is performed in the discharge cell 550.

The address electrodes A1 to Am supply an address signal (ADD) provided from an address driver 201 to the discharge cell 550 to be synchronized with the scan signal (SCA), so that the discharge cell for the display discharge is selected.

Meanwhile, the address driver 201, a scan driver 301, and a sustain driver 401 are connected to a plurality of electrodes formed on the display panel 501 by TCP (Tape Carrier Package) 299 and FFC (Flexible Flat Cable) 399 and 499.

Figure 7:
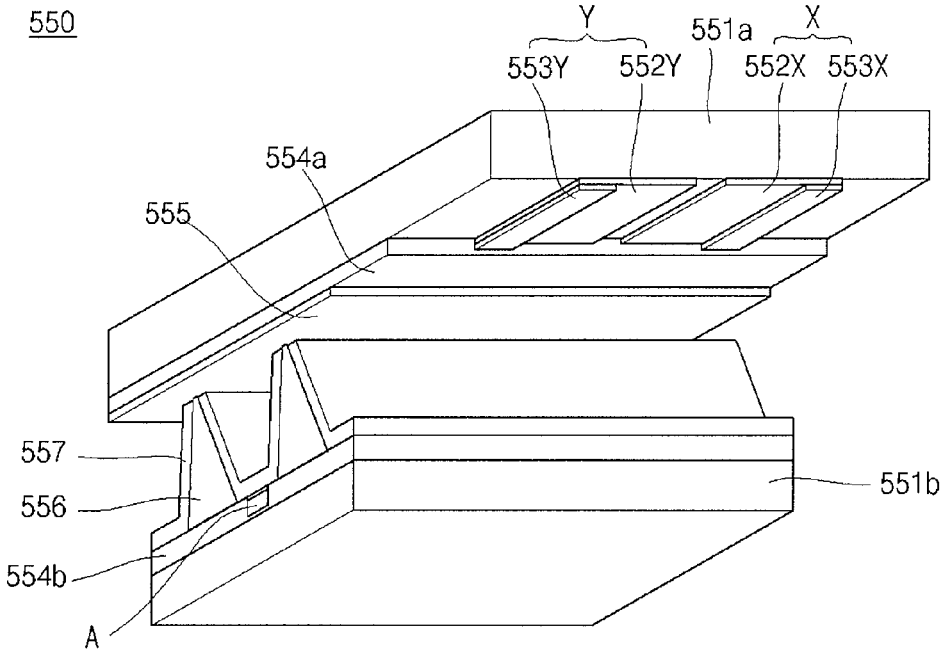
FIG. 7 is a perspective diagram illustrating the structure of a discharge cell applicable to an embodiment of the present invention.

FIG. 7 is a perspective diagram illustrating the structure of a discharge cell (e.g., a discharge cells of a 3-electrode surface discharge type and upper 2-electrode type plasma display panels) of an embodiment of the present invention.

Referring to FIG. 7, the display panel 550 includes a front substrate 551*a*, a rear substrate 551*b*, upper electrodes Y and X, dielectric layers 554*a*, 554*b*, a protective film 555, a lower electrode A, a barrier rib 556, and a phosphor layer 557.

The upper electrodes Y and X are formed on a surface of the front substrate 551*a* facing the rear substrate 551*b*. The upper electrodes Y and X include the scan electrode Y and the sustain electrode X. In addition, the lower electrode A is formed on a surface of the rear substrate 551*b* facing the front substrate 551*a* so as to cross the upper electrodes Y and X, and is used as an address electrode A. The upper electrodes Y and X respectively include transparent electrodes 552 (552Y, 552X) and metal bus electrodes 553 (553Y, 553X). In FIG. 7, the metal bus electrodes 553 (553Y, 553X) are formed on a side of the transparent electrodes 552 (552Y, 552X), but are not limited thereto.

The transparent electrodes 552 are generally formed of indium tin oxide (ITO), indium zinc oxide (IZO), indium tin zinc oxide (ITZO), and equivalents thereof. The metal bus electrodes 553 are formed of chromium, copper, silver, gold, or equivalent metals, and decrease a voltage drop of a signal voltage by compensating for the high resistance of the transparent electrodes 552. An upper dielectric layer 554*a* is formed on the front substrate 551*a* on which the scan electrode Y and the sustain electrode X are formed, and the protective film 555 is formed on the upper dielectric layer 554*a*.

The protective film 555 reduces or prevents damage of the upper dielectric layer 554*a* by the sputtering generated at the time of the plasma discharge and increases the discharge efficiency of the second electrons. MgO may be used as the protective film 555.

A lower dielectric layer 554*b*, the barrier rib 556, and the phosphor layer 557 are formed on the rear substrate 551*b*. In FIG. 7, the barrier rib 556 is formed in one direction, but various modifications may be made.

Figure 8:
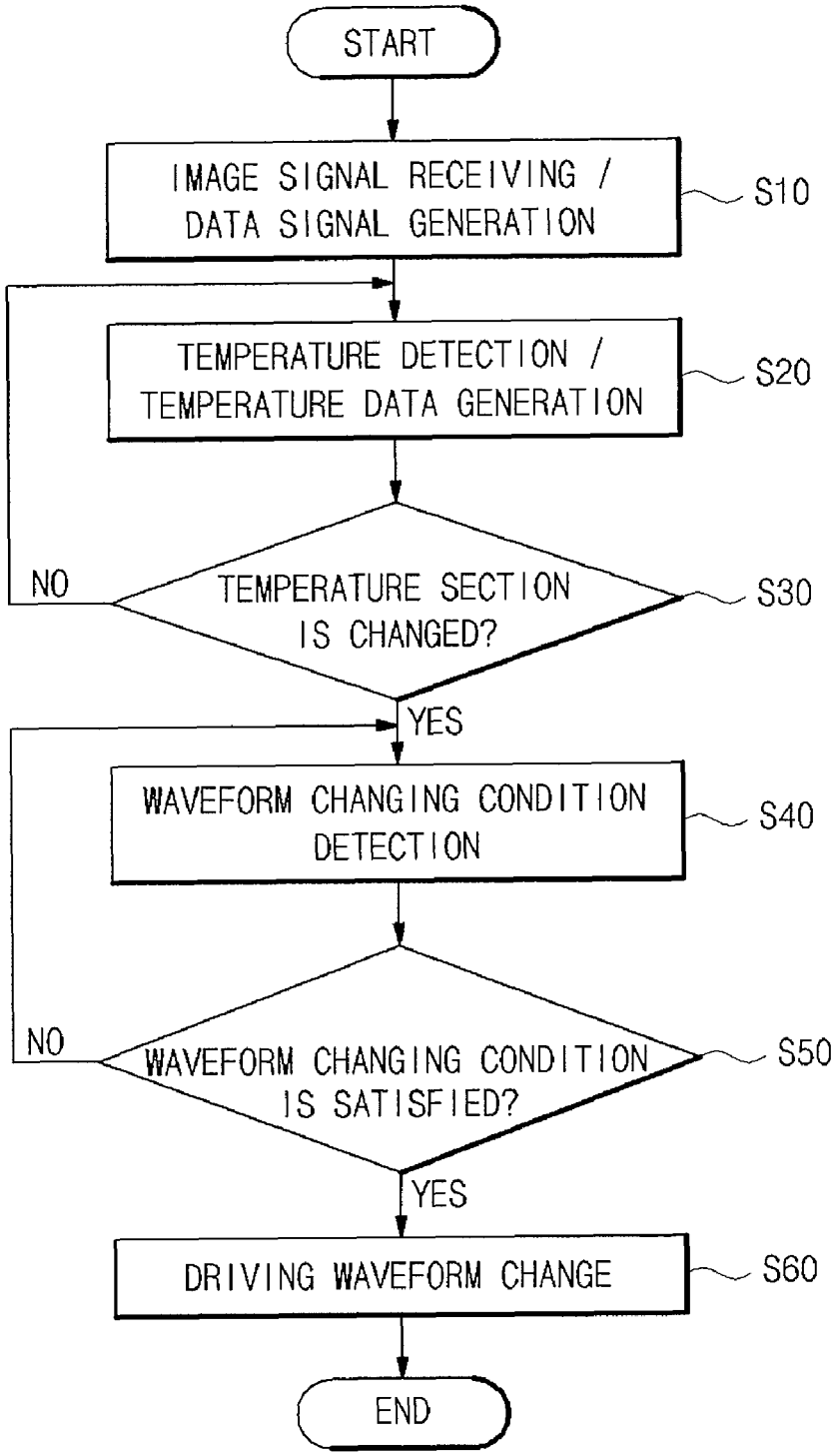
FIG. 8 is a flow chart illustrating a driving method of the plasma display device according to an embodiment of the present invention.

FIG. 8 is a flow chart illustrating a method of driving the plasma display device according to the present invention.

Referring to FIG. 8, the method of driving the plasma display device includes steps of generating a data signal S10, generating temperature data S20, identifying a temperature section S30, detecting a waveform changing condition S40, determining the satisfaction of the waveform changing condition S50, and changing a driving waveform S60.

In step S10, a logic controller receives an image signal inputted from an external device and changes the received image signal to a data signal (DS). A gray scale level of the data signal (DS) is determined and the data signal (DS) may be divided into subfields.

In step S20, the temperature of the display panel is detected according to the driving of the display panel, and the temperature data (TED) is generated by using the detected temperature. The temperature detection may be performed by a request from the logic controller, but may be performed periodically with a certain period.

In step S30, temperature section information (TSD) is compare with the generated temperature data (TED). The temperature section of the display panel is identified, and, when the temperature of the display panel enters into a different temperature section, the next step proceeds. However, when the temperature of the display panel is maintained in the present temperature section, the temperature section information is repeatedly compared with the temperature data (TED) provided continually.

In step S40, the waveform changing condition (PCC) to reduce or prevent flicker generation is detected. In step S40, the waveform changing condition (PCC) is detected when the temperature of the display panel enters into a different temperature section (TS) in step S30. In step S40, a measurement of the average signal level (ASL), a calculation of the optical axis by an optical histogram, and a calculation for the gray level data of the screen are performed as described above.

In step S50, after the measurement of the average signal level (ASL), the calculation of the optical axis by the optical histogram and the calculation of the gray level data of the screen are performed; the average signal level (ASL) is compared with the reference average signal level (BASL); the gray level data is compared with the reference data; and whether or not the calculated optical axis matches the optical axis changed by the driving waveform or can be adjustable to an approximate value is determined. If the result of the determination does not satisfy the condition, steps S40 and S50 are repeated until the condition is satisfied.

In step S60, if the waveform changing condition (PCC) is satisfied, a driving control signal (DCS) is generated for providing a driving waveform applicable in the temperature section (TS) for the temperature of the display panel. The driving waveform in the corresponding temperature section is generated according to the driving control signal.

Figure 9A:
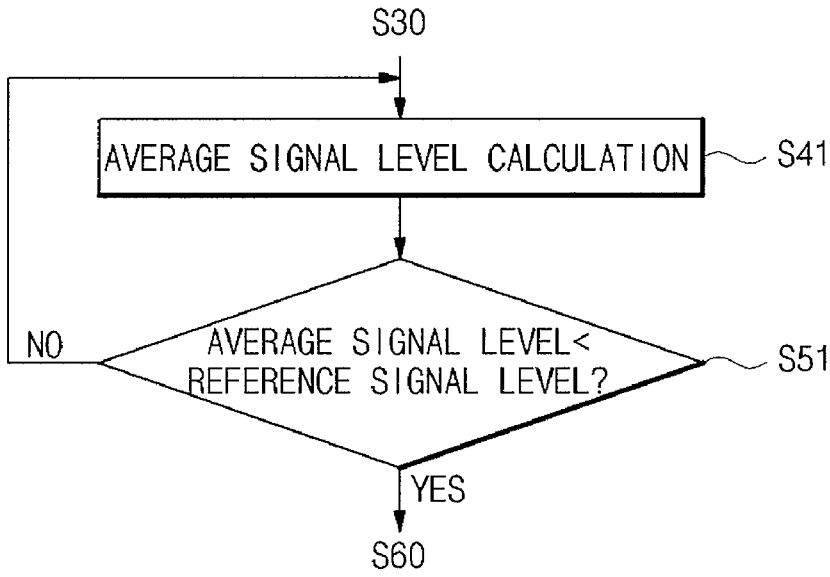
FIGS. 9*a*, 9*b* and 9*c* are flow charts illustrating steps S40 and S50 of FIG. 8.
Figure 9B:
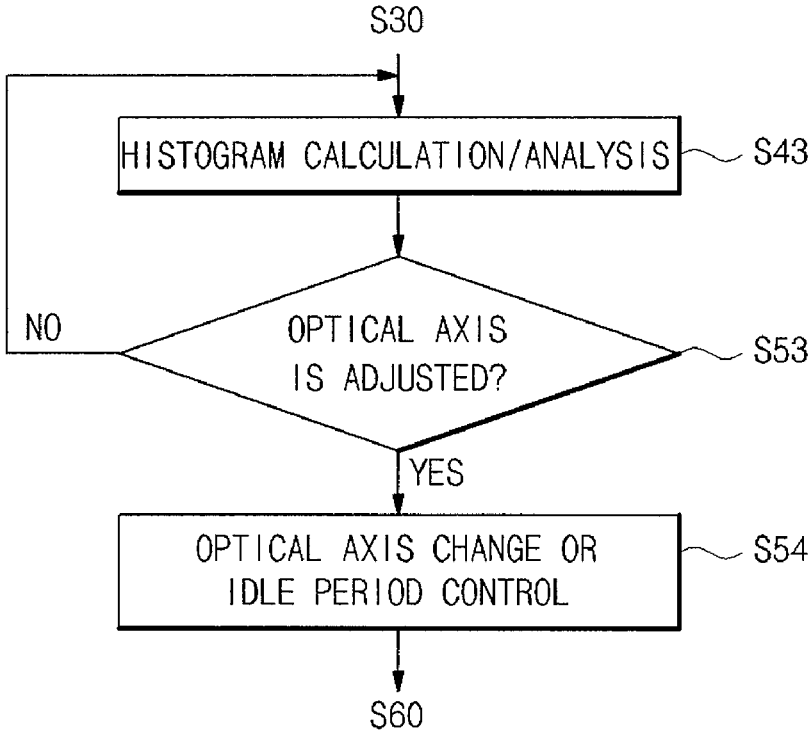
Figure 9C:
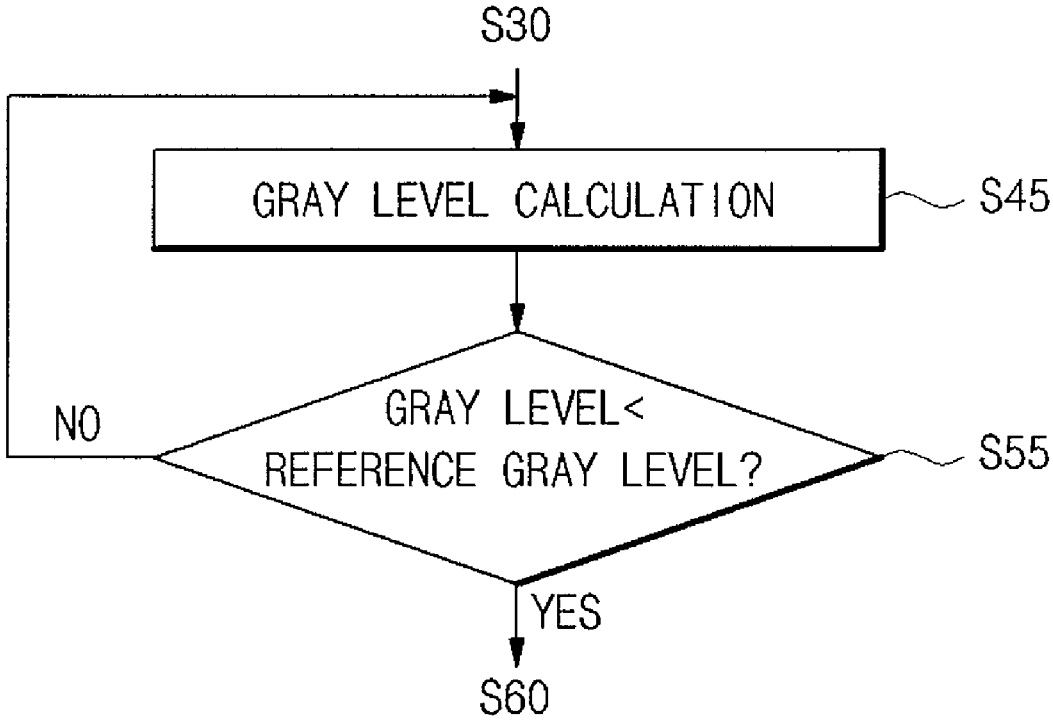

FIGS. 9*a*, 9*b*, and 9*c* are flow charts illustrating steps S40 and S50.

Referring to FIGS. 9*a* to 9*c*, in the case where the average signal level (ASL) is used, as shown in FIG. 9*a*, step S40 becomes an average signal level calculating step S41. In step S41, the average signal level of the corresponding subfield or frame is calculated from the data signal (DS). In this case, the calculated average signal level may be a level value of the full screen or a level value of a part of the display panel, for example, a level value of a defined area in the middle of the display panel.

When the average signal level (ASL) is calculated, the average signal level (ASL) is compared with a reference average signal level (BASL) (e.g., a predetermined reference average signal level (BASL)) by a step S51 of comparing the average signal level (ASL) and the reference average signal level (BASL) that corresponds to step S50 in FIG. 8. In this case, when the average signal level (ASL) is larger than the reference average signal level (BASL), step S41 is performed again. When the average signal level (ASL) is lower than the reference average signal level (BASL), step S60 is performed.

FIG. 9*b* illustrates the case that uses an optical histogram. The optical histogram of the plasma display device is calculated for detecting the waveform changing condition (PCC) S43. Accordingly, the position of the optical axis can be calculated, and whether or not the matching or approximation of the optical axis is determined in step S53 of determining optical axis adjustment corresponds to step S50. That is, when the optical axis is moved by the driving waveform different from the former driving waveform, the time gap between the former optical axis and the new optical axis is identified, and the generation of flicker is predicted, or whether or not the time of the optical axis can be gradually changed so that the user could not recognize the movement of the optical axis is determined. When the generation of flicker is predicted in step S54, steps S43 and S53 are repeated until data satisfying the conditions is inputted.

If the condition is satisfied, the information for change or delay of the optical axis is provided S54. The change or delay of the optical axis can be easily realized by addition and adjustment of the idle time (IDS).

FIG. 9*c* shows the case that uses a gray level data. The step S40 in FIG. 8 corresponds to a gray level calculating step S45. In this step S45, the gray level of the full screen or part of the screen is calculated.

In step S55 corresponding to step S50, the calculated gray level is compared with a reference gray level (e.g., a predetermined reference gray level), and if the calculated gray level is larger than the reference gray level, steps S45 and S55 are performed until a gray level data less than the reference gray level is inputted.

Figure 10:
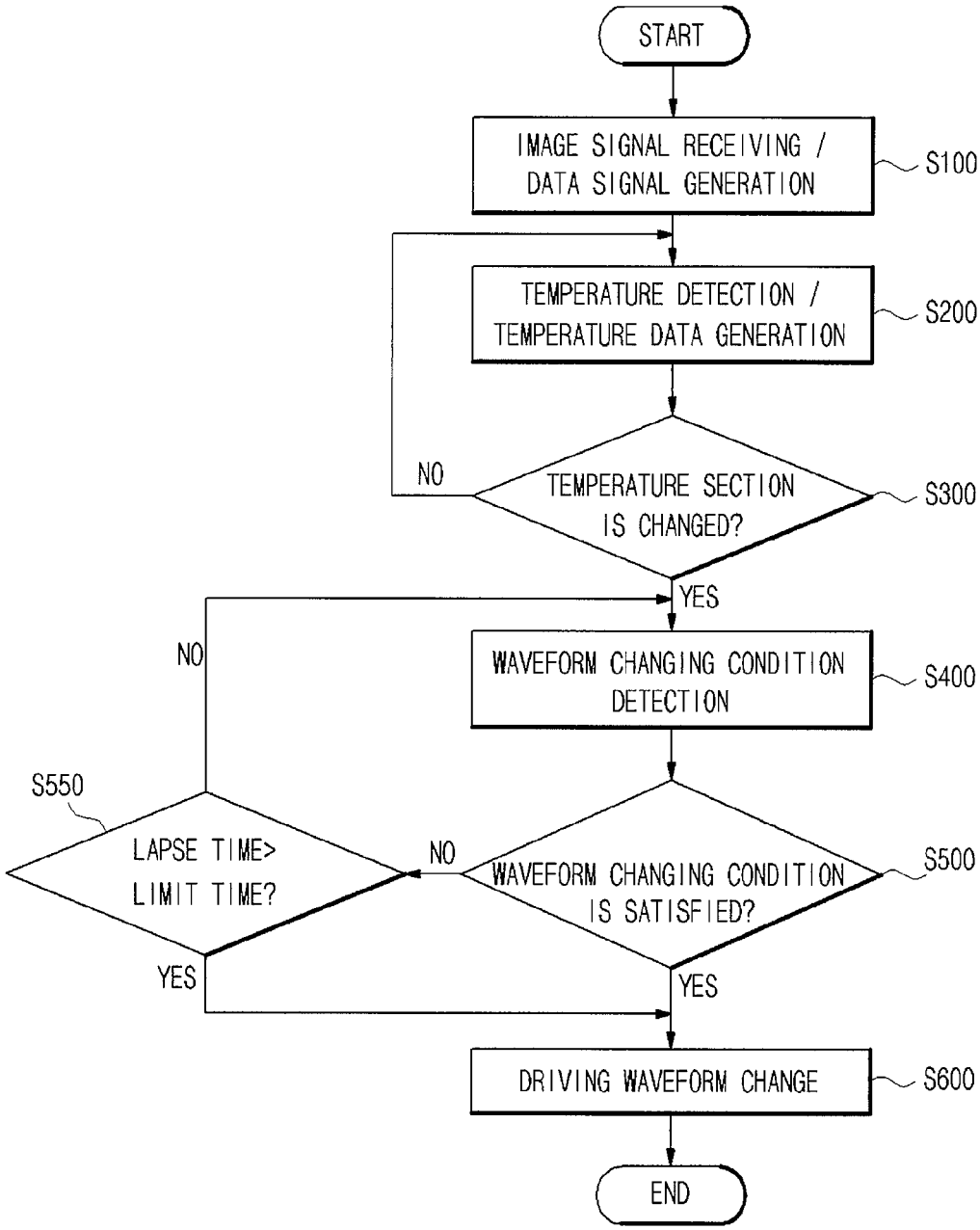
FIG. 10 is a flow chart illustrating a driving method where a limit time has been applied.

FIG. 10 is a flow chart illustrating a driving method in the case where a limit time is applied.

FIG. 10 is similar to FIG. 8 except that steps S400 to S600 are somewhat different from the steps S40 to S60 in FIG. 8. Therefore, the detailed description for the elements similar to FIG. 8 will be omitted and only the elements different from FIG. 8 will be described in detail.

The method of driving the plasma display device includes steps of generating a data signal S100, generating temperature data S200, confirming a temperature section S300, detecting a waveform changing condition S400, determining whether the waveform changing condition is satisfied S500, and changing the driving waveform S600.

When the waveform changing condition (PCC) is detected in the step S400, whether the driving waveform is changed is determined in step S500. In this case, if the calculated waveform changing condition (PCC) does not satisfy the changing condition of the driving waveform, the time that the temperature of the display panel is entered into the present temperature section (TS) is measured, and whether the elapsed time (TH) after the temperature of the display panel is entered into the present temperature section exceeds a limit time (L11) is determined S550. If the elapsed time (TH) is within the limit time (L11), it returns to the waveform changing condition detecting step S400. If the elapsed time (TH) exceeds the limit time (L11), it goes to a step S600 of changing the driving waveform. Accordingly, the driving waveform is changed regardless of the satisfaction of the waveform changing condition (PCC).

As described above, the plasma display device and driving method thereof, according to an embodiment of the present invention, produces the following effects.

First, when the plasma display device is driven by the different driving waveform according to the temperature, the generation of flicker can be minimized by changing and selecting the changing time of the changed driving waveform.

Second, by providing various methods for determining the supply time to reduce or minimize flicker when changing the driving waveform, the generation of flicker and the recognition of flicker by user can be reduced or minimized.

Third, by providing the range of the supply time for reducing or preventing the production of misfiring while reducing or minimizing the generation of flicker by restricting the range of the supply time, a high quality of display can be displayed.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A plasma display device comprising:

a display panel for displaying an image according to a driving signal converted from an external image signal;

a logic controller for measuring a temperature of the display panel for comparison with a temperature section information having at least two temperature sections, generating a driving control signal for changing the driving signal after the temperature of the display panel changes to a temperature of a different temperature section, and calculating a changing condition included in the driving control signal for determining a changing time of the driving signal; and a driver for supplying the driving signal that is changed according to the temperature section at the changing time determined by the changing condition of the driving control signal, wherein the changing time is a time after the temperature of the display panel changes to a temperature of a different temperature section, and is the time when one of an optical axis calculated by an optical histogram analysis for the image signal is within a reference range of the optical axis, and the time when an amount of light emitted according to the image signal is below a reference amount of light.

2. The plasma display device of claim 1, wherein the logic controller comprises a timer for measuring an entering time period when the temperature of the display panel changes to a temperature of a different temperature section.

3. The plasma display device of claim 2, wherein the driver is configured to change and supply the driving signal prior to the changing condition when the entering time period exceeds a limit time.

4. The plasma display device of claim 1, wherein the time when the amount of light emitted according to the image signal is below the reference amount of light is a time when an average signal level of the image signal is below a reference average signal level.

5. The plasma display device of claim 4, wherein the image signal is an image signal that corresponds to 50% of the display panel comprising a central part of the display panel.

6. The plasma display device of claim 1, wherein the time when the amount of light emitted according to the image signal is below the reference amount of light is a time when a displayed gray level of the image signal is below a reference gray level.

7. The plasma display device of claim 1, wherein the temperature sections comprise a low temperature section, a normal temperature section, and a high temperature section.

8. The plasma display device of claim 7, wherein the low temperature section is less than about 18° C., the normal temperature section is more than about 18° C. and less than about 50° C., and the high temperature section is more than about 50° C.

9. The plasma display device of claim 7, wherein the driving signal comprises a signal where a main reset is supplied at least twice in the low temperature section.

10. The plasma display device of claim 7, wherein in the driving signal, at least one of a charging time and a discharging time of an energy recovery circuit in the high temperature section is shorter in duration than at other temperature sections.

11. A method of driving a plasma display device utilizing a driving signal, converted from an external image signal according to a temperature section based on a temperature of a display panel, the method comprising:

measuring the temperature of the display panel;

comparing the measured temperature with temperature section information having at least two temperature sections;

generating a driving control signal for changing the driving signal after the measured temperature changes to a temperature within a different temperature section;

calculating a changing condition included in the driving control signal for determining a changing time of the driving signal;

selecting the changing time, which is a time after the measured temperature changes to a temperature within a different temperature section, by the changing condition according to the driving control signal; and supplying the driving signal for each of the temperature sections according to the selected changing time, wherein the selected changing time comprises the time when one of an optical axis calculated by an optical histogram analysis of the image signal is within a reference range of the optical axis, and the time when an amount of light emitted according to the image signal is below a reference amount of light.

12. The method of claim 11, further comprising measuring an entering time period when the temperature of the display panel is changed to a temperature within a different temperature section.

13. The method of claim 12, further comprising determining whether the entering time period exceeds a limit time.

14. The method of claim 13, wherein said determining comprises supplying the driving signal that corresponds to the temperature section prior to the changing condition when the entering time period exceeds the limit time.

15. The method of claim 11, wherein the time when the amount of light emitted according to the image signal is below the reference amount of light is a time when an average signal level of the image signal is below a reference average signal level.

16. The method of any one of claim 15, wherein the image signal corresponds to 50% of the area of the display panel comprising a central part of the display panel.

17. The method of claim 11, wherein the time when the amount of light emitted according to the image signal is below the reference amount of light is a time when an screen gray level of the image is below a reference screen gray level.

18. The method of claim 11, wherein the temperature sections comprise a low temperature section, a normal temperature section and a high temperature section.

19. The method of claim 18, wherein the low temperature section is less than about 18° C., the normal temperature section is more than about 18° C. and less than about 50° C., and the high temperature section is more than about 50° C.

20. The method of claim 19, wherein said supplying comprises supplying a main reset at least twice in the low temperature section.

21. The method of claim 19, wherein said supplying comprises changing at least one of a charging time and a discharging time of an energy recovery circuit in the high temperature section, so as to have a shorter duration than other temperature sections.

* * * * *